US008558781B2

(12) United States Patent
Wu et al.

(10) Patent No.: US 8,558,781 B2
(45) Date of Patent: Oct. 15, 2013

(54) COLOR SEQUENTIAL DISPLAY WHERE EACH SUB-FRAME IS ILLUMINATED BY A SECONDARY COLOR BACKLIGHT FOLLOWED BY ILLUMINATION WITH THE COMPLEMENTARY PRIMARY COLOR BACKLIGHT

(75) Inventors: Chih-Lei Wu, Taipei (TW); Wen-Chih Tai, Taoyuan County (TW); Chih-Chun Chang, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 769 days.

(21) Appl. No.: 12/546,692

(22) Filed: Aug. 25, 2009

(65) Prior Publication Data

US 2010/0283801 A1 Nov. 11, 2010

(30) Foreign Application Priority Data

May 5, 2009 (TW) ..... 98114880 A

(51) Int. Cl.
*G09G 3/36* (2006.01)

(52) U.S. Cl.
USPC ..... 345/102; 345/88

(58) Field of Classification Search
USPC ..... 345/87–105, 589–605
See application file for complete search history.

(56) References Cited

U.S. PATENT DOCUMENTS

| | | | | |
|---|---|---|---|---|
| 2002/0122019 | A1* | 9/2002 | Baba et al. | 345/88 |
| 2007/0132680 | A1* | 6/2007 | Kagawa et al. | 345/84 |
| 2007/0139449 | A1* | 6/2007 | Bergquist et al. | 345/691 |
| 2008/0259099 | A1* | 10/2008 | Arai et al. | 345/690 |
| 2010/0079366 | A1* | 4/2010 | Lin et al. | 345/102 |
| 2010/0149435 | A1* | 6/2010 | Kataoka | 348/744 |

FOREIGN PATENT DOCUMENTS

| | | | |
|---|---|---|---|
| CN | 1428630 | | 7/2003 |
| FR | 2887673 | | 12/2006 |
| FR | 2887673 | A1 * | 12/2006 |
| JP | 2000352701 | A * | 12/2000 |
| JP | 2001-014319 | | 1/2001 |
| JP | 2001-281623 | | 10/2001 |
| JP | 2001-290122 | | 10/2001 |

(Continued)

OTHER PUBLICATIONS

"First Office Action of China Counterpart Application", issued on Dec. 1, 2010, p. 1-p. 4, in which the listed references were cited.

*Primary Examiner* — Chanh Nguyen
*Assistant Examiner* — Navin Lingaraju
(74) *Attorney, Agent, or Firm* — Jianq Chyun IP Office

(57) ABSTRACT

A color sequential control method adapted to a field sequential color display is provided. The field sequential color display includes a display panel and a backlight module. The backlight module provides a backlight source to the display panel, wherein the backlight source includes a red backlight, a green backlight and a blue backlight. The color sequential control method includes following steps. First, a frame period of the display panel is sequentially divided into a first, a second and a third sub-frame periods. Next, a cyan backlight and the red backlight are provided in sequence during a first backlight period of the first sub-frame period. Then, a magenta backlight and the green backlight are provided in sequence during a second backlight period of the second sub-frame period. Finally, a yellow backlight and the blue backlight are provided in sequence during a third backlight period of the third sub-frame period.

13 Claims, 7 Drawing Sheets

(56) References Cited

FOREIGN PATENT DOCUMENTS

| | | | | |
|---|---|---|---|---|
| JP | 2001-311411 | | | 11/2001 |
| JP | 2001-318363 | | | 11/2001 |
| JP | 2003241714 | A | * | 8/2003 |
| JP | 2003280614 | A | * | 10/2003 |
| TW | 200844929 | | | 11/2008 |

* cited by examiner

COLOR SEQUENTIAL DISPLAY WHERE EACH SUB-FRAME IS ILLUMINATED BY A SECONDARY COLOR BACKLIGHT FOLLOWED BY ILLUMINATION WITH THE COMPLEMENTARY PRIMARY COLOR BACKLIGHT

CROSS-REFERENCE TO RELATED APPLICATION

This application claims the priority benefit of Taiwan application serial no. 98114880, filed May 5, 2009. The entirety of the above-mentioned patent application is hereby incorporated by reference herein and made a part of specification.

BACKGROUND OF THE INVENTION

1. Field of the Invention

The present invention is related to a color sequential control method, and more particularly, to a color sequential control method and a field sequential color display using the method.

2. Description of Related Art

In recent years, flat panel displays are developed rapidly owing to mature photoelectric technology and semiconductor manufacturing technology. Liquid crystal displays (LCDs) advantageous in small volume, low-voltage operation, no-radiation, lightness, and lower electromagnetic interference have gradually become a mainstream produce in the market.

The LCD mainly includes a liquid crystal panel and a backlight module. As the liquid crystal injected into the liquid crystal panel does not emit light itself, the liquid crystal panel must be illuminated by a surface light source provided by the backlight module, so that the LCD can display images.

Color display mixing method of the LCD is mainly classified into two types, namely temporal color mixing and spatial color mixing, which is so-called simultaneous additive color mixing. Currently, the spatial color mixing is the commonly used color display mixing in displays. Taking thin-film transistor LCD (TFT-LCD) for example, each pixel is composed of three sub-pixels of red, green, blue (RGB) distributed on a color filter. When the sub-pixels are small beyond the distinguishable viewing angle of human eyes, a color mixing effect is observed by visual perception.

If the spatial color mixing of the TFT-LCD is replaced by the temporal color mixing, there is no need to use the color filter to achieve the color mixing effect. Instead, different color backlights are directly used in sequence with relative data to display images, so as to achieve the temporal color mixing effect and to display a color frame. Hence, the transmission rate of the module is increased and the overall manufacturing cost of the module is decreased.

FIG. 1 is an architectural diagram of a driving circuit of a conventional field sequential color display (FSCD) 1000. Referring to FIG. 1, an FSCD controller 1400 is used to convert a spatial parallel RGB video data at a system of a video source 1200 into a temporal serial R→G→B video data and then output it. Next, the FSCD controller 1400 synchronously controls a backlight module 1600 according to different primary color data to generate a corresponding light source so that a display panel 1800 displays a color frame.

In addition, in order to prevent a false color mixing when the RGB data is written during data scanning, the light source of the backlight module 1600 is turned on or off according to data scanning.

FIG. 2 is a conventional FSCD driving waveform diagram. Referring to FIG. 2, when the data is written, the light source of the backlight module 1600 is turned off. After the data is written, the light source of the backlight module 1600 is turned on, so that the temporal color mixing of the RGB is achieved and the false color mixing is prevented. Besides, since the temporal color mixing method divides a color frame into R, G and B the three primary color images and 180 Hz image updating frequency of the LCSD needs to be achieved when the R, G and B color images are displayed in sequence during a frame period. It represents that the response time of the liquid crystal needs to be at least below 5.56 ms, such that the false color mixing is prevented.

However, when human eyes move rapidly relative to the display screen due to random viewing or an instinct for tracing a moving object, the R, G, and B images of the object do not fall at the same location of the retina. This results in color breakup (CBU) or perceived spatial separation of the R, G, and B components as using the FSCD. Besides, the CBU usually forms a color band around the edge of the object, which is like a rainbow, and hence the CBU is so-called rainbow effect.

The CBU not only reduces the image quality, but also makes observers feel dizzy after a long time onlooking which is pointed out by some reports. Present methods of reducing the CBU mainly performs by increasing the response rate of liquid crystal, by changing the sequence of color fields, or by using dynamic picture compensation . . . and so on. However the above methods are unable to eliminate the CBU effectively throughout, and all need complex control algorithm as well as formidable driving circuit ability so that the mass production of the FSCD is limited.

SUMMARY OF THE INVENTION

The present invention provides a color sequential control method that adjusts the color of a backlight according to a CRMGYB color sequence and adjusts the enable period of the backlight with different colors according to a color gamut space, so that color breakup (CBU) occurs as using a field sequential color display (FSCD) is reduced and the high contrast ratio and the high brightness of the FSCD is maintained.

The present invention provides a field sequential color display (FSCD) using the above-mentioned color sequential control method, so as to reduce the color breakup (CBU) and maintain a definite quality of the FSCD in color saturation and the brightness.

The present invention provides a color sequential control method adapted to a field sequential color display (FSCD). The FSCD includes a liquid crystal display (LCD) panel and a backlight module. The backlight module provides a backlight source to the display panel, wherein the backlight source includes a red backlight, a blue backlight, and a green backlight. The color sequential control method includes following steps. First, a frame period of the display panel is sequentially divided into a first sub-frame period, a second sub-frame period, and a third sub-frame period. Next, a cyan backlight and the red backlight are provided in sequence during a first backlight period of the first sub-frame period. Then, a magenta backlight and the green backlight are provided in sequence during a second backlight period of the second sub-frame period. Finally, the yellow backlight and the blue backlight are provided in sequence during a third backlight period of the third sub-frame period.

In an embodiment of the present invention, the color sequential control method includes following steps. First, a red image data is written into the display panel during the first sub-frame period. Next, a green image data is written into the display panel during the second sub-frame period. Then, a blue image data is written into the display panel during the third sub-frame period.

In an embodiment of the present invention, the color sequential control method further comprises providing the cyan backlight during a first sub backlight period of the first backlight period of the first sub-frame period and providing the red backlight during a second sub backlight period of the first backlight period of the first sub-frame period.

In an embodiment of the present invention, the color sequential control method further comprises calculating a minimum color gamut space according to a maximum chroma of the red image data, a maximum chroma of the green image data, and a maximum chroma of the blue image data and determining a ratio of the first sub backlight period to the second sub backlight period according to the minimum color gamut space.

In an embodiment of the present invention, the color sequential control method further comprises determining if the minimum color gamut space is less than or equal to 50% of an original color gamut space of the backlight source. When the minimum color gamut space is less than or equal to 50% of the original color gamut space, the second sub backlight period is 100% in the first backlight period.

In an embodiment of the present invention, the color sequential control method further comprises providing the magenta backlight during a first sub backlight period of the second backlight period of the second sub-frame period and providing the green backlight during a second sub backlight period of the second backlight period of the second sub-frame period.

In an embodiment of the present invention, the color sequential control method further comprises determining if the minimum color gamut space is less than or equal to 50% of an original color gamut space of the backlight source. When the minimum color gamut space is less than or equal to 50% of the original color gamut space, the second sub backlight period is 100% in the second backlight period.

In an embodiment of the present invention, the color sequential control method further comprises providing the yellow backlight during a first sub backlight period of the third backlight period of the third sub-frame period and providing the blue backlight during a second sub backlight period of the third backlight period of the third sub-frame period.

In an embodiment of the present invention, the color sequential control method further comprises determining if the minimum color gamut space is less than or equal to 50% of an original color gamut space of the backlight source. When the minimum color gamut space is less than or equal to 50% of the original color gamut space, the second sub backlight period is 100% in the third backlight period.

In an embodiment of the present invention, the cyan backlight is composed by the green and the blue backlights.

In an embodiment of the present invention, the magenta backlight is composed by the red and the blue backlights.

In an embodiment of the present invention, the yellow backlight is composed by the red and the green backlights.

From another aspect, the present invention further provides a field sequential color display (FSCD). The FSCD includes a display panel and a backlight module. A frame period of the display panel is sequentially divided into a first sub-frame period, a second sub-frame period, and a third sub-frame period. The backlight module provides a backlight source to the display panel, wherein the backlight source includes a red backlight, a blue backlight and a green backlight. The backlight module sequentially provides a cyan backlight and the red backlight during a first backlight period of the first sub-frame period, then sequentially provides a magenta backlight and the green backlight during a second backlight period of the second sub-frame period, and sequentially provides a yellow backlight and the blue backlight during a third backlight period of the third sub-frame period.

In an embodiment of the present invention, the field sequential color display further includes a FSCD controller which includes a processing module. The processing module writes a red image data into the display panel during the first sub-frame period, then writes a green image data into the display panel during the second sub-frame period, and writes a blue image data into the display panel during the third sub-frame period.

In an embodiment of the present invention, each of the above-mentioned backlight periods includes a first sub backlight period and a second sub backlight period. The backlight module provides the cyan backlight during a first sub backlight period of the first backlight period and provides the red backlight during a second sub backlight period of the first backlight period. Then, the backlight module provides the magenta backlight during a first sub backlight period of the second backlight period, and provides the green backlight during a second sub backlight period of the second backlight period. Finally, the backlight module provides the yellow backlight during a first sub backlight period of the third backlight period, and provides the blue backlight during a third sub backlight period.

In an embodiment of the present invention, the processing module according to a maximum chroma of the red image data, a maximum chroma of the green image data, and a maximum chroma of the blue image data calculates a minimum color gamut space and determines a ratio of the first sub backlight period to the second sub backlight period according to the minimum color gamut space.

In an embodiment of the present invention, the processing module includes a chroma analyzing unit, a color gamut deciding unit, and a data generating unit. The chroma analyzing unit analyzes the red image data, the green image data and the blue image data to obtain a first red image data corresponding to a maximum chroma of the red image data, a first green image data corresponding to a maximum chroma of the green image data, and a first blue image data corresponding to a maximum chroma of the blue image data. The color gamut deciding unit coupled to the chroma analyzing unit calculates the minimum color gamut space according to the first red image data, the first green image data, and the first blue image data. The color gamut deciding unit generates a first pulse width modulation (PWM) control signal, a second PWM control signal, and a third PWM control signal according to the minimum color gamut space so as to adjust the ratio of the first sub backlight period to the second sub backlight period. The data generating unit sequentially outputs the red image data, the green image data, and the blue image data.

In an embodiment of the present invention, the color gamut deciding unit includes a first transformation matrix unit, a color gamut analyzing unit, a second transformation matrix unit, a backlight compensation unit, and a PWM generating unit. The first transformation matrix unit calculates a first reference coordinate, a second reference coordinate, and a third reference coordinate in a CIE1931 color space chromaticity diagram which respectively correspond to the first red image data, first green image data, and first blue image data.

The color gamut analyzing unit determines the minimum color gamut space upon the first reference coordinate, the second reference coordinate, and the third reference coordinate and outputs the first reference coordinate, the second reference coordinate, and the third reference coordinate. The second transformation matrix unit respectively transforms the first reference coordinate, the second reference coordinate, and the third reference coordinate into the first red image, the first green image data, and the first blue image data. The backlight compensation unit determines the ratio of the first sub backlight period to the second sub backlight period according to the minimum color gamut space so as to generate a first backlight control signal, a second backlight control signal, and a third backlight control signal. The PWM generating unit generates the first PWM control signal, the second PWM control signal, and the third PWM control signal respectively according to the first backlight control signal, the second backlight control signal, and the third backlight control signal, so as to adjust the ratio of the first sub backlight period to the second sub backlight period.

In an embodiment of the present invention, the backlight compensation unit determines if the minimum color gamut space is less than or equal to 50% of an original color gamut space of the backlight. When the minimum color gamut space is less than or equal to 50% of the original color gamut space, the second sub backlight period is 100% in the first backlight period.

In summary, the color sequential control method and the FSCD of the present invention adjust the enable period of the backlight with different colors according to a concept of color gamut space shrinking so as to decrease the CBU perceived by human eyes. In addition, the color sequential control method of the present invention further uses the cyan, magenta and the yellow backlights during the disable period of the red, green and blue backlights so as to maintain the color expression of the FSCD. Thus, the FSCD of the present invention is able to maintain a definite quality in color saturation and brightness.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
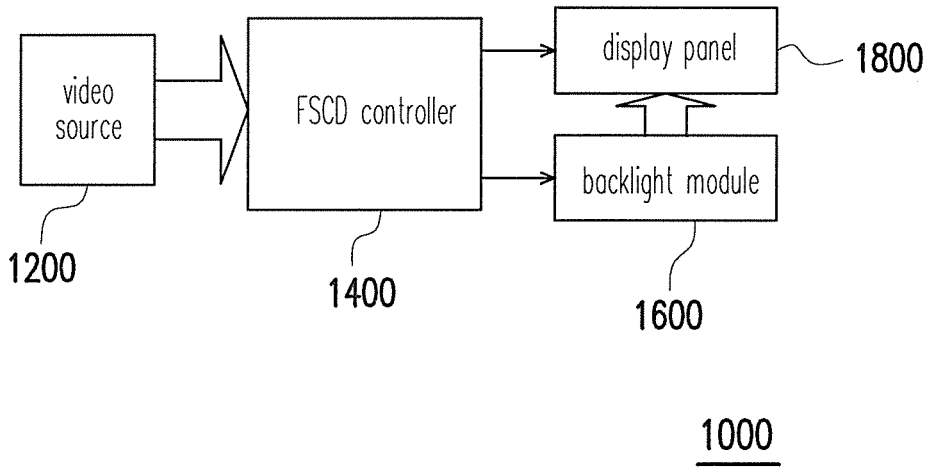
FIG. 1 (PRIOR ART)
FIG. 1 is a circuit structure diagram of a driving circuit of a conventional field sequential color display.
Figure 2:
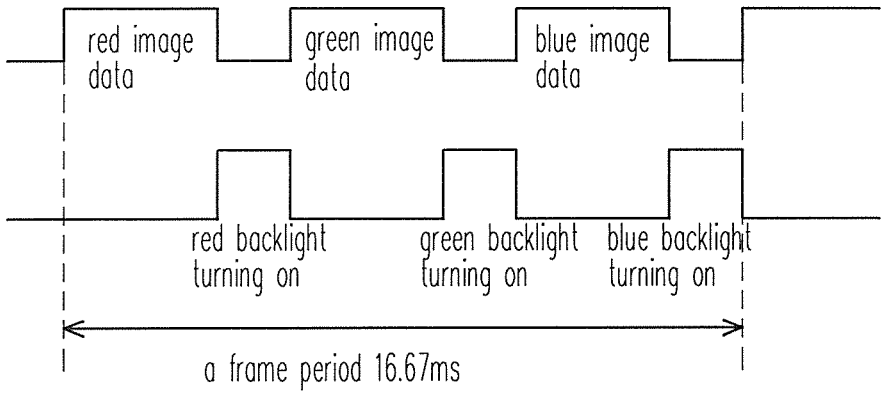
FIG. 2 (PRIOR ART)
FIG. 2 is a conventional FSCD driving waveform diagram.
Figure 3A:
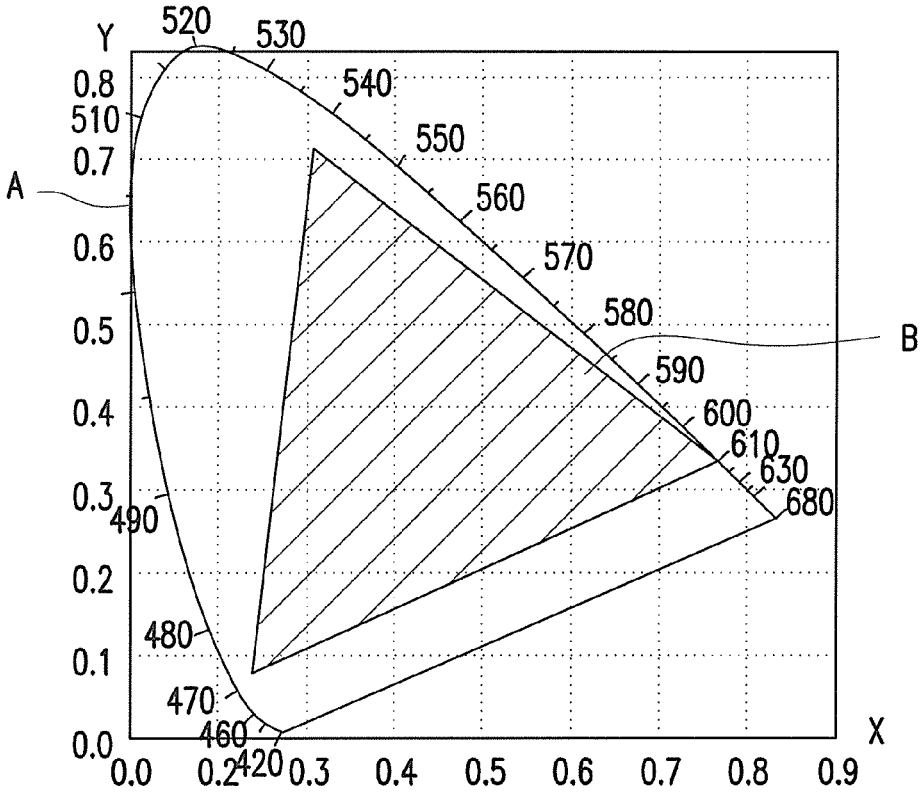
FIG. 3A is a 100% NTSC color gamut diagram formulated by CIE in 1931.

People ordinarily skilled in the art should know that the Commission International De'l E'clairage (CIE) formulated a color gamut in 1931, and a color gamut space is region A as shown in FIG. 3A. The region A represents a color space perceivable by human eyes. As shown in FIG. 3A, basically, all color gamut coordinates of different colors are represented as (x, y), which mainly represents a color gamut formed by three primary colors, i.e. red, green and blue. A triangular region B as shown in FIG. 3A represents a color range that a liquid crystal display (LCD) can display. Hence, the more color the LCD can display, the larger the triangular region B is, and the less color the LCD can display, the smaller the triangular region B is.

Figure 3B:
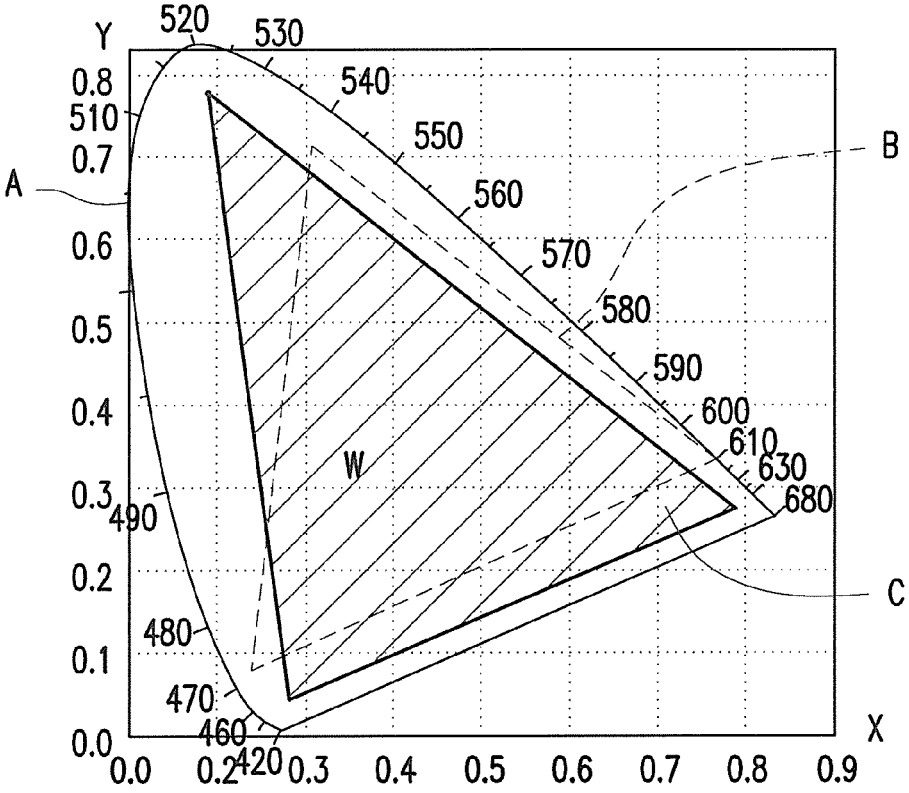
FIG. 3B is a 123.19% NTSC color gamut diagram formulated by CIE in 1931.

However, the color gamut space of a LCD is not the larger the better. As shown in FIG. 3B, although the color gamut space of a LCD in FIG. 3B is larger than the color gamut space of a LCD in FIG. 3A, i.e. region C is larger than the region B, the white point W in FIG. 3B is relatively bluish. Hence, if the region C is used to be the color gamut space of a FSCD without appropriately color correction, a severe CBU occurs. Since the FSCD can display more various colors, each of the color fields of an object falling at different locations of the retina is more serious. Conversely, by shrinking the color gamut space of region B in FIG. 3A, the color expression of the FSCD is decreased, so that the CBU perceived by human eyes is reduced.

In view of the above, the present invention provides a color sequential control method and a FSCD using the method. The high color saturation of light emitting diodes (LEDs) is considered in the control method, and the control method uses the concept of color gamut space shrinking to deduce the CBU perceived by human eyes. The technical features and technical effects of the present invention are described in detail as follows for reference.

Figure 4A:
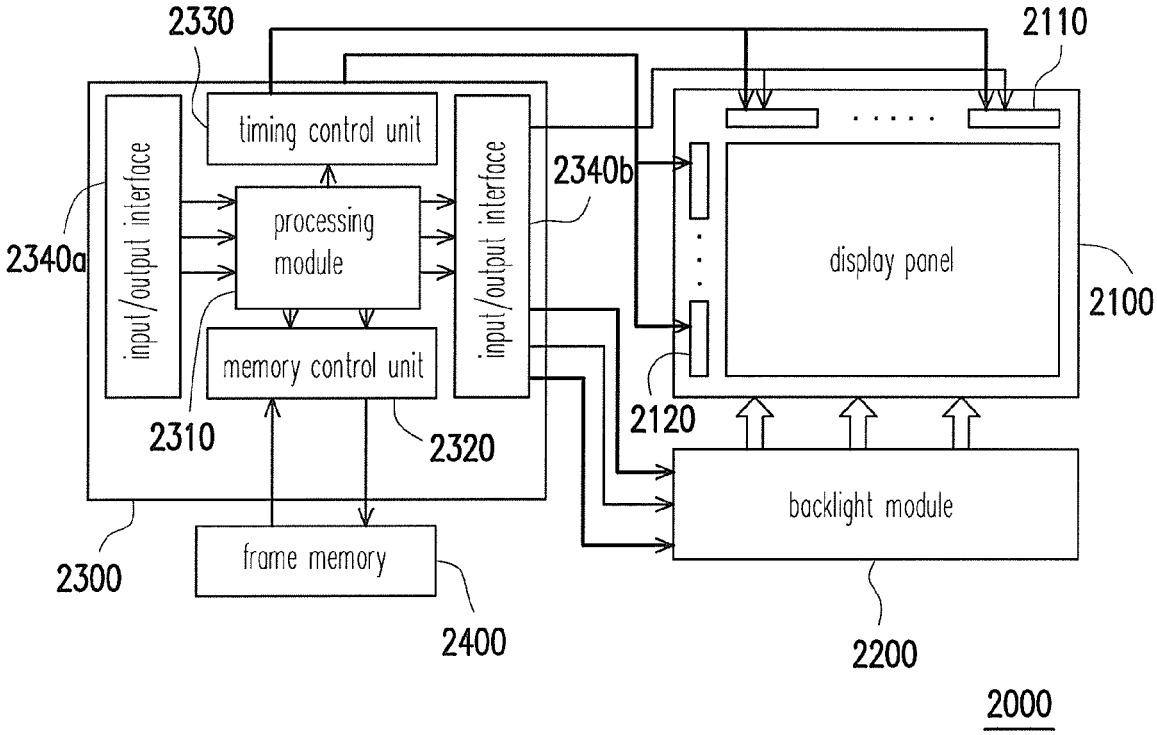
FIG. 4A is a driving circuit structure diagram of a FSCD in an exemplary embodiment of the present invention.

FIG. 4A is a driving circuit structure diagram of a field sequential color display (FSCD) in an exemplary embodiment of the present invention. Referring to FIG. 4A, a FSCD 2000 includes a display panel 2100, a backlight module 2200, a sequential color controller 2300, and a frame memory 2400 for saving data. In the exemplary embodiment, the sequential color controller 2300 further includes a processing module 2310, a memory control unit 2320, a timing control unit 2330, and two input/output interfaces 2340*a*, 2340*b*.

The timing control unit 2330 transmits a timing signal to a source driver 2110 and a gate driver 2120. The memory control unit 2320 controls data accessing of the frame memory 2400.

Figure 5:
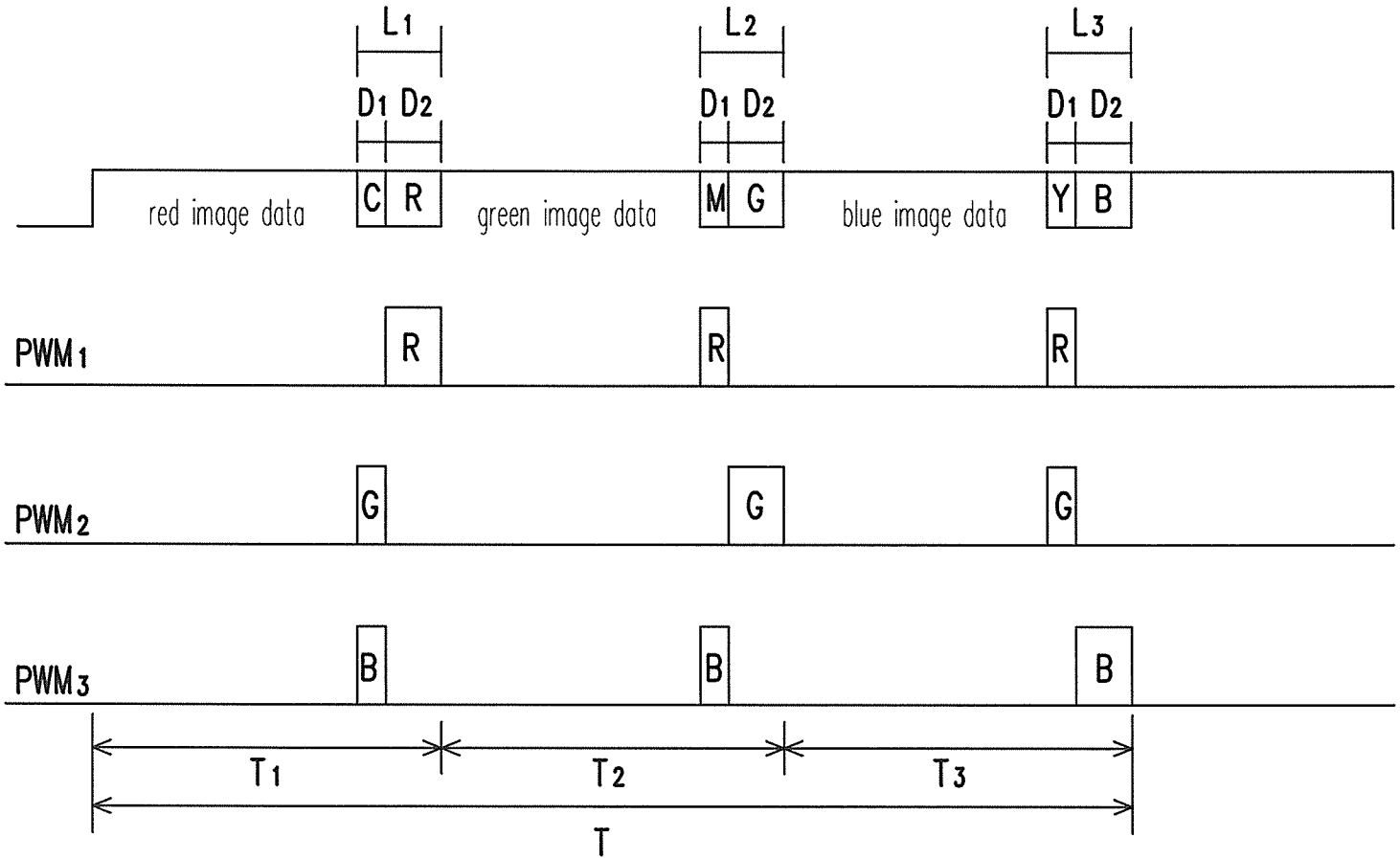
FIG. 5 is a driving waveform diagram of a FSCD in FIG. 4A.

FIG. 5 is a driving waveform diagram of a FSCD in FIG. 4A. Referring to both FIG. 4A and FIG. 5, in the exemplary embodiment, a frame period T of the display panel 2100 is sequentially divided into a first sub-frame period $T_1$, a second sub-frame period $T_2$, and a third sub-frame period $T_3$. In the time axis, an original frame frequency is 60 frames per second (fps), i.e. a complete frame is displayed within every 16.67 ms. Thus, a frame frequency of the FSCD 2000 of the embodiment must be increased to such as 180 fps, i.e. each of sub-frames is displayed within $1/180$ s≈5.56 ms, and every three sub-frames compose a complete color frame.

In the exemplary embodiment, the backlight module 2200 provides a backlight source (not shown) to the display panel 2100, wherein the backlight source includes a red backlight, a green backlight, and a blue backlight. The processing module 2310 respectively writes a red image data, a green image data, and a blue image data into the display panel 2100 during the first sub-frame period $T_1$, the second sub-frame period $T_2$, and the third sub-frame period $T_3$. Meanwhile, the backlight module 2200 respectively provides corresponding backlights during the first sub-frame period $T_1$, the second sub-frame period $T_2$, and the third sub-frame period $T_3$ for displaying the color frame.

In the related art, the backlights corresponding to the first sub-frame period $T_1$, the second sub-frame period $T_2$, and the third sub-frame period $T_3$ are respectively a red, a green, and a blue backlights. However, the backlight module 2200 of the embodiment sequentially provides a cyan (C) and a red (R) backlights to display the red image data during a first backlight period $L_1$ of the first sub-frame period $T_1$, then sequentially provides a magenta (M) and a green (G) backlight to display the green image data during a second backlight period $L_2$ of the second sub-frame period $T_2$, and sequentially provides a yellow (Y) and a blue (B) backlights to display the blue image data during a third backlight period $L_3$ of the third sub-frame period $T_3$.

The enable periods of the R, G and B backlights are respectively controlled by duty cycles of a first pulse width modulation (PWM) control signal $PWM_1$, a second PWM control signal $PWM_2$, and a third PWM control signal $PWM_3$. The cyan (C) backlight is composed by the green and the blue backlights. Hence, the first PWM control signal $PWM_1$ used to control the red backlight is disabled during a first sub backlight period $D_1$ of the first backlight period $L_1$, and the second PWM control signal $PWM_2$ used to control the green backlight and the third PWM control signal $PWM_3$ used to control the blue backlight are both enabled. Besides, only the first PWM control signal $PWM_1$ used to control the red backlight is enabled during a second sub backlight period $D_2$ of the first backlight period $L_1$.

The magenta backlight (M) is composed by the red and the blue backlights. Hence, the second PWM control signal $PWM_2$ used control the green backlight is disabled during a first sub backlight period $D_1$ of the second backlight period $L_2$, and the first PWM control signal $PWM_1$ used to control the red backlight and the third PWM control signal $PWM_3$ used to control the blue backlight are both enabled. Besides, only the second PWM control signal $PWM_2$ used to control the green backlight is enabled during a second sub backlight period $D_2$ of the second backlight period $L_2$.

The yellow backlight (Y) is composed by the red and the green backlights. Hence, the third PWM control signal $PWM_3$ used to control the blue backlight is disabled during a first sub backlight period $D_1$ of the third backlight period $L_3$, and the first PWM control signal $PWM_1$ used to control the red backlight and the second PWM control signal $PWM_2$ used to control the green backlight are both enabled. Besides, only the third PWM control signal $PWM_3$ used to control the blue backlight is enabled during a second sub backlight period $D_2$ of the third backlight period $L_3$.

In view of the above and FIG. 5, the sequence of the backlights, which is provided by the backlight module 2200, is CRMGYB, wherein the R, G, and B backlights are mainly used to display the corresponding R, G, and B image data, and the inserted C, M, and Y backlights are used to enhance the gray level and the colorfulness of the frame.

And a ratio of the first sub backlight period $D_1$ to the second sub backlight period $D_2$ of each of the backlight periods $L_1$~$L_3$ is determined upon a maximum chroma of the red, the green and the blue image data in one frame. For example, the ratio of the C and R backlights is determined upon the maximum chroma of the red image data. During displaying, the sequential color controller 2300 calculates a minimum color gamut space according to the maximum chroma of the red image data, a maximum chroma of the green image data, and a maximum chroma of the blue image data. Then, the sequential color controller 2300 determines the ratios of the first sub backlight period $D_1$ to the second sub backlight period $D_2$ of the backlight period $L_1$~$L_3$ upon the minimum color gamut space.

Figure 4B:
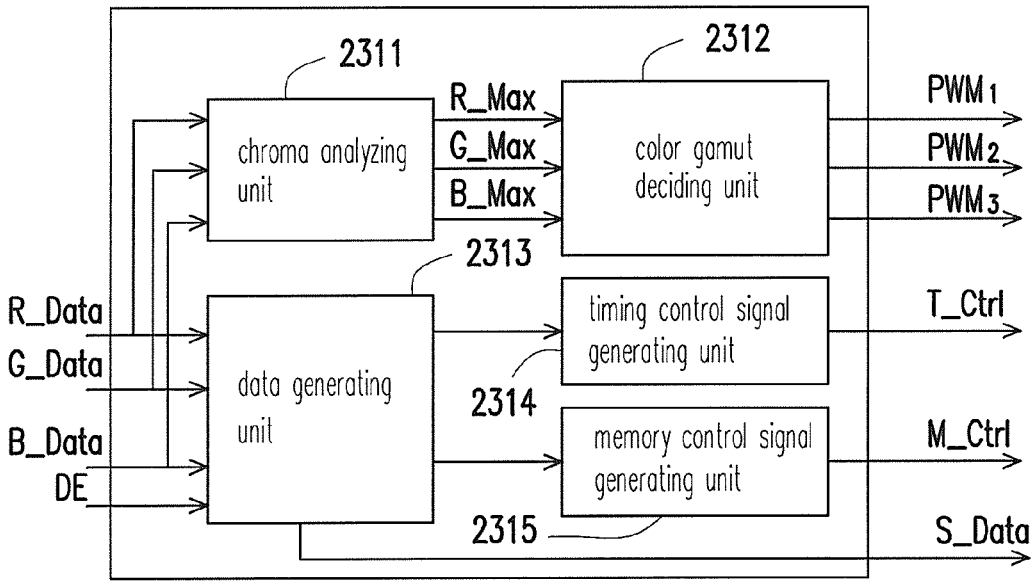
FIG. 4B is a detailed circuit structure diagram of a processing module in FIG. 4A.

Next, a circuit structure of the processing module 2310 is further explained. FIG. 4B is a detailed circuit structure diagram of the processing module 2310 in FIG. 4A. As shown in FIG. 4B, the processing module 2310 includes a chroma analyzing unit 2311, a color gamut deciding unit 2312, a data generating unit 2313, a timing control signal generating unit 2314, and a memory control signal generating unit 2315. The data generating unit 2313 receives a red image data R_Data, a green image data G_Data, and a blue image data B_Data. Then, the data generating unit 2313 transforms the image data R_Data, G_Data and B_Data into a serial frame data S_Data and outputs the serial frame data S_Data to the source driver 2110. Meanwhile, the data generating unit 2313 outputs a synchronization signal DE to the timing control signal generating unit 2314 and the memory control signal generating unit 2315, such that the timing control signal generating unit 2314 generates a double-frequency control signal T_Ctrl and the memory control signal generating unit 2315 generates a control signal M_Ctrl for accessing the frame memory 2400.

In the exemplary embodiment, the chroma analyzing unit 2311 analyzes the red image data R_Data, the green image data G_Data and the blue image data B_Data to respectively obtain a first red image data R_Max corresponding to a maximum chroma of the red image data R_Data, a first green image data G_Max corresponding to a maximum chroma of the green image data G_Data, and a first blue image data B_Max corresponding to a maximum chroma of the blue image data B_Data.

The color gamut deciding unit 2312 is coupled to the chroma analyzing unit 2311, and calculates the minimum color gamut space according to the first red image data R_Max, the first green image data G_Max and the third blue image data B_Max. Then, the color gamut deciding unit 2312 generates the first PWM control signal $PWM_1$, the second PWM control signal $PWM_2$, and the third PWM control signal $PWM_3$ according to the minimum color gamut space. The first PWM control signal $PWM_1$, the second PWM control signal $PWM_2$, and the third PWM control signal $PWM_3$ are respectively used to control the ratios of the first sub backlight period $D_1$ to the second sub backlight period $D_2$ of the first backlight period $L_1$, a third backlight period $L_2$, and the third backlight period $L_3$.

Figure 4C:
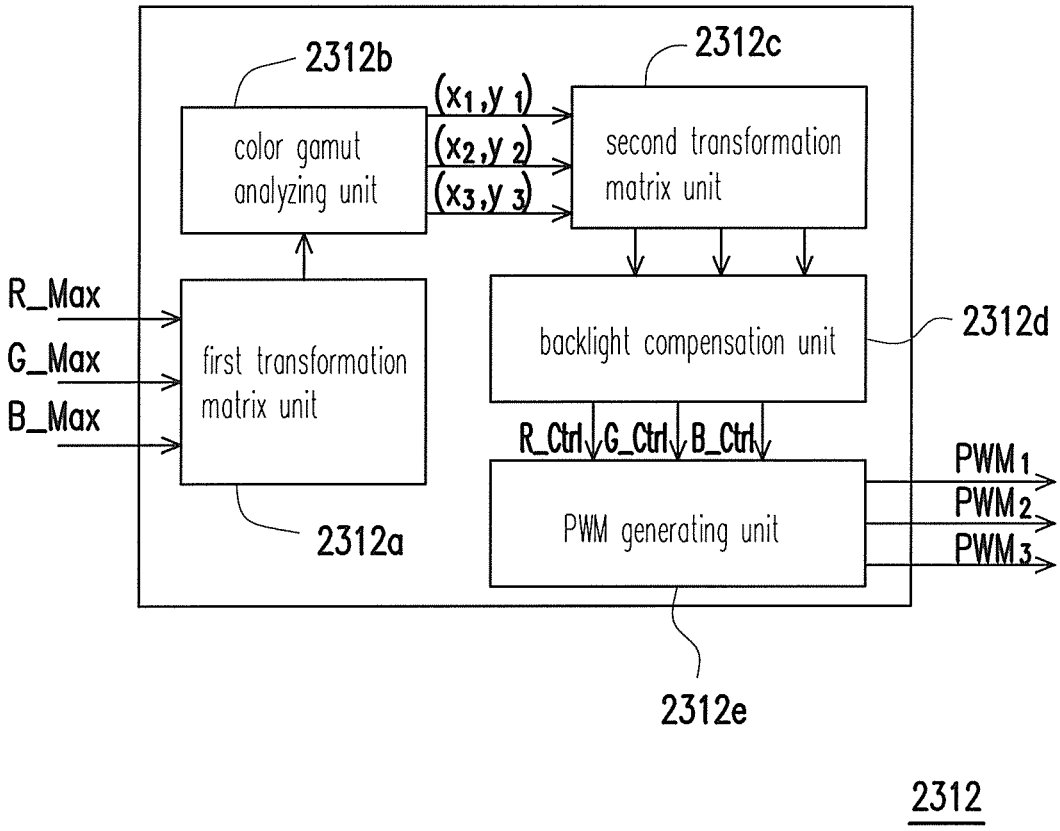
FIG. 4C is a detailed circuit structure diagram of a color gamut deciding unit in FIG. 4B.

FIG. 4C is a detailed circuit structure diagram of the color gamut deciding unit in 2312 FIG. 4B. As shown in FIG. 4C, the color gamut deciding unit 2312 includes a first transformation matrix unit 2312*a*, a color gamut analyzing unit 2312*b*, a second transformation matrix unit 2312*c*, a backlight compensation unit 2312*d*, and a PWM generating unit 2312*e*.

The first transformation matrix unit 2312*a* receives the first red image data R_Max, the first green image data G_Max, and the first blue image data B_Max from the chroma analyzing unit 2311. Then, the first transformation matrix unit 2312*a* calculates a first reference coordinate $(x_1, y_1)$ corresponding to the first red image data R_Max, a second reference coordinate ($x_2$, $y_2$) corresponding to the first green image data G_Max, and a third reference coordinate ($x_3$, $y_3$) corresponding to first blue image data B_Max in a CIE1931 color space chromaticity diagram as shown in FIG. 6.

Figure 6:
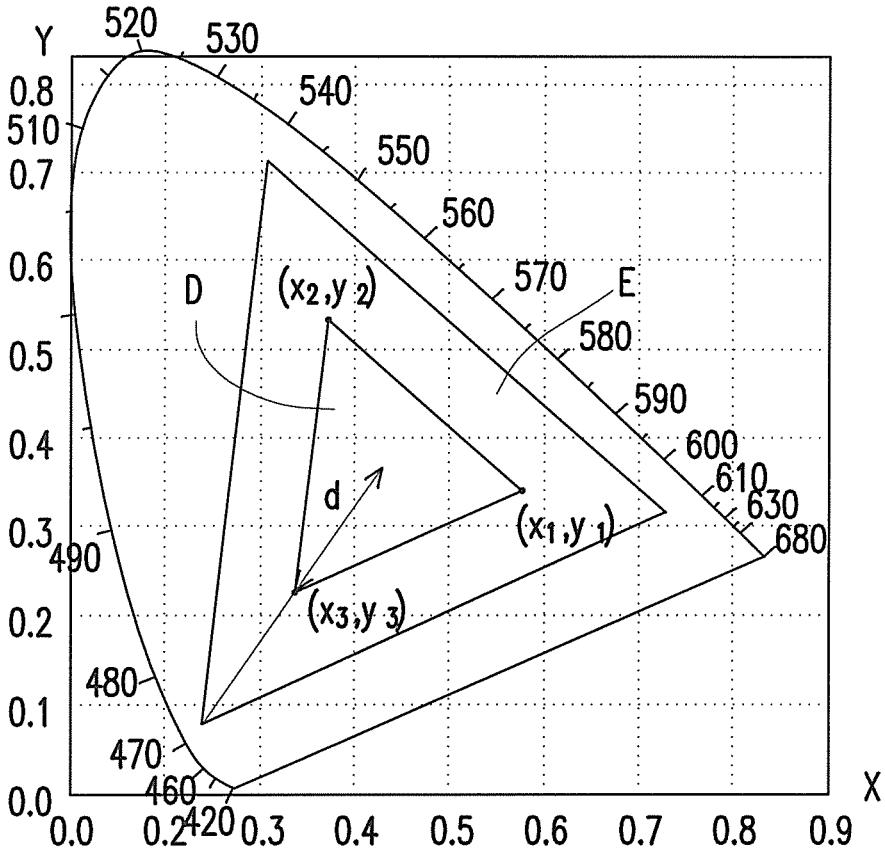
FIG. 6 is a schematic diagram of a concept of color gamut space shrinking in an exemplary embodiment of the present invention.

Referring to both FIG. 4C and FIG. 6. Next, the color gamut analyzing unit 2312*b* determines a minimum color gamut space (i.e. region D) upon a triangular region formed by the first reference coordinate ($x_1$, $y_1$), the second reference coordinate ($x_2$, $y_2$), and the third reference coordinate ($x_3$, $y_3$). Then, the color gamut analyzing unit 2312*b* outputs the first reference coordinate ($x_1$, $y_1$), the second reference coordinate ($x_2$, $y_2$), and the third reference coordinate ($x_3$, $y_3$) to the second transformation matrix unit 2312*c*. In addition, a region E in FIG. 6 represents an original color gamut space the FSCD 2000 is able to display.

Besides, the second transformation matrix unit 2312*c* respectively transforms the first reference coordinate ($x_1$, $y_1$), the second reference coordinate ($x_2$, $y_2$), and the third reference coordinate ($x_3$, $y_3$) back to the first red image R_Max, the first green image data G_Max, and the first blue image data B_Max and then transmits relative information of the minimum color gamut space to the backlight compensation unit 2312*d*.

Then, the backlight compensation unit 2312*d* determines the ratios of the first sub backlight period $D_1$ to the second sub backlight period $D_2$ of the first backlight period $L_1$, the second backlight period $L_2$, and the third backlight period $L_3$ (as shown in FIG. 5) upon the minimum color gamut space (region D) so as to respectively generate a first backlight control signal R_Ctrl, a second backlight control signal G_Ctrl, and a third backlight control signal B_Ctrl. The operation of the backlight compensation unit 2312*d* is explained in followings. First, the backlight compensation unit 2312*d* determines if the present minimum color gamut space (region D) is less than or equal to 50% of the original color gamut space (region E). If the present minimum color gamut space (region D) is less than or equal to 50% of the original color gamut space (region E), the present frame is not suitable for color gamut space shrinking. Namely, the backlight module 2200 as shown in FIG. 4A provides the red (R) backlight during all the first backlight period $L_1$, the green (G) backlight during all the second backlight period $L_2$, and the blue (B) backlight during all the first backlight period $L_3$. That is the second sub backlight period $D_2$ is 100% in the first backlight period $L_1$, in the second backlight period $L_2$, and in the third backlight period $L_3$.

In the contrary, if the present minimum color gamut space (region D) is greater than 50% of the original color gamut space (region E), the backlight compensation unit 2312*d* distributes the ratio of the first sub backlight period $D_1$ (as shown in FIG. 5) to the second sub backlight period $D_2$, which is determined upon the size of the minimum color gamut space (region D). Specifically, the smaller the region D is (i.e. the shorter a major color axis d is), the longer the first sub backlight period $D_1$ is, and the larger the region D is (i.e. the longer the major color axis d is), the shorter the first sub backlight period $D_1$ is. Hence, the backlight compensation unit 2312*d* outputs a first backlight control signal R_Ctrl, a second backlight control signal G_Ctrl, and a third backlight control signal B_Ctrl to the PWM generating unit 2312*e* respectively according to the ratios of the first sub backlight period $D_1$ to the second sub backlight period $D_2$ of the first backlight $L_1$, the second backlight $L_2$, and the third backlight $L_3$. Afterwards, the PWM generating unit 2312*e* generates the first PWM control signal $PWM_1$, the second PWM control signal $PWM_2$, and the third PWM control signal $PWM_3$ as shown in FIG. 5 respectively according to the first backlight control signal R_Ctrl, the second backlight control signal G_Ctrl, and the third backlight control signal B_Ctrl, so as to dynamically adjust the backlights.

It should be noted that the above-mentioned determination if the minimum color gamut space (region D) is less than or equal to 50% of the original color gamut space (region E) is based on the design demands and the application of displays. In another exemplary embodiment of the present invention, the determination is able to be omitted and the backlight compensation unit 2312*d* directly adjusts each of the enable periods of the backlights according to the minimum color gamut space.

Figure 7:
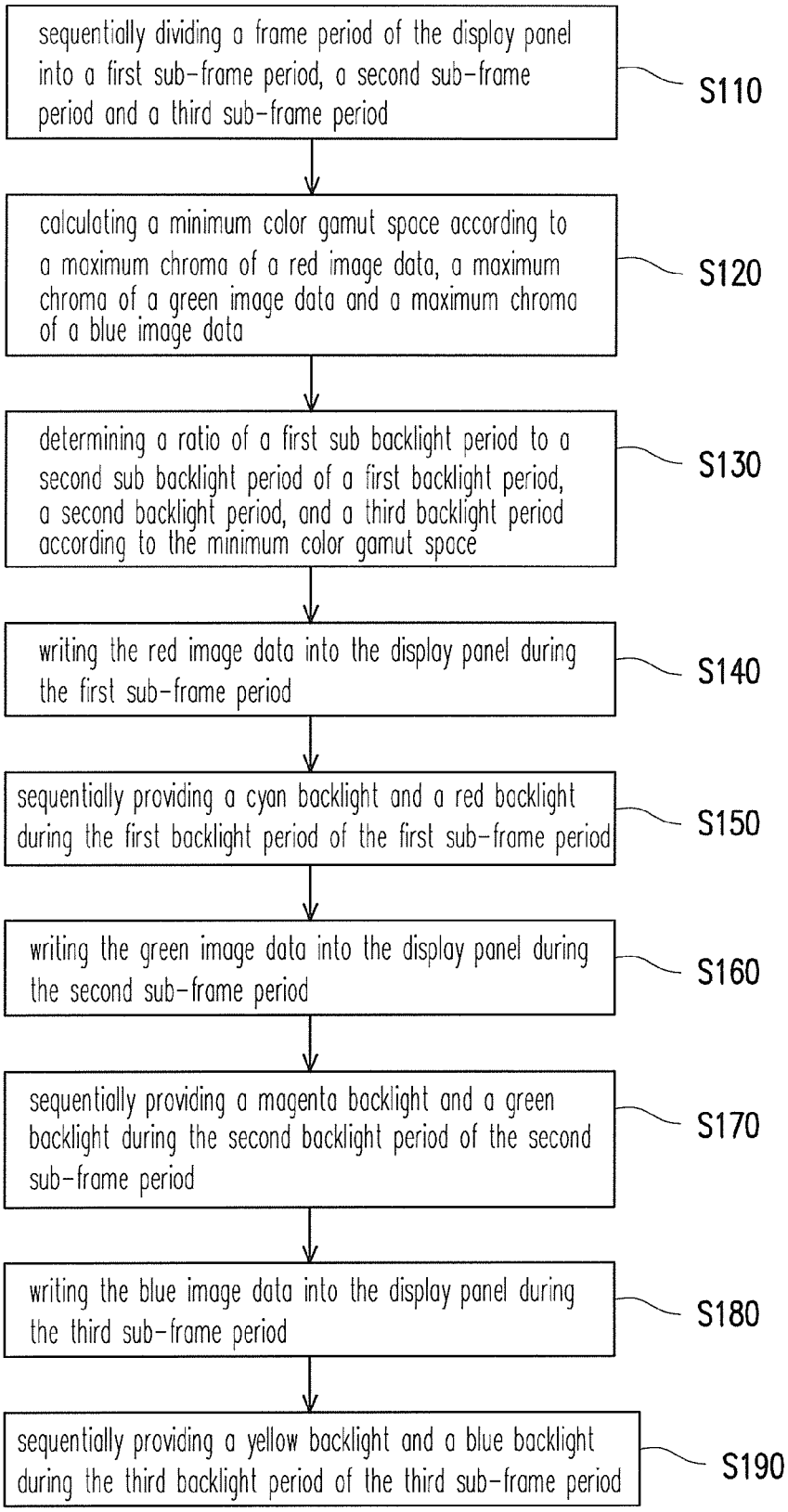
FIG. 7 is a flow chart of a color sequential control method of a FSCD in FIG. 4A.

From another viewpoint, the aforementioned embodiment summarizes a color sequential control method adapted to a FSCD, which includes a display panel and a backlight module. The backlight module provides a backlight source to the display panel, wherein the backlight source includes a red backlight, a blue backlight and a green backlight. The above-mentioned method is illustrated in FIG. 7. FIG. 7 is a flow chart of the color sequential control method of the FSCD 2000 in FIG. 4A. As shown in FIG. 7, the exemplary embodiment of the invention includes following steps. First, the frame period T of the display panel is sequentially divided into the first sub-frame period $T_1$, the second sub-frame period $T_2$, and the third sub-frame period $T_3$ (step S110).

Then, a minimum color gamut space according to a maximum chroma of the red image data, a maximum chroma of the green image data, and a maximum chroma of the blue image data is calculated (step S120). Next, ratios of the first sub backlight period $D_1$ to the second sub backlight period $D_2$ of the first backlight period $L_1$, the second backlight $L_2$ and the third backlight period $L_3$ are determined upon the minimum color gamut space.

Later, a red image data is written into the display panel during the first sub-frame period $T_1$ (step S140), and the cyan (C) and the red (R) backlights are provided in sequence during the first backlight period $L_1$ of the first sub-frame period $T_1$ (step S150). Then, a green image data is written into the display panel during the second sub-frame period $T_2$ (step S160), and the magenta (M) and the green (G) backlights are provided in sequence during the second backlight period $L_2$ of the second sub-frame period $T_2$ (step S170). Finally, a blue image data is written into the display panel during the third sub-frame period $T_3$ (step S180), and the yellow (Y) and the blue (B) backlights are provided in sequence during the third backlight period $L_3$ of the third sub-frame period $T_3$ (step S190).

Afterwards, the above-mentioned steps are repeated to adjust the ratios of the first sub backlight period to the second sub backlight period of each of the backlight periods according to the minimum color gamut space which is calculated according to R, G, and B image data of each of frames. Hence, the CBU is reduced by using the backlight display sequence CRMGYB.

In addition, the step S130 of the embodiment of the present invention can further include determining if the minimum color gamut space is less than or equal to 50% of an original color gamut space of the backlight source. If yes, the red (R) backlight is provided during all the first backlight period $L_1$, the green (G) backlight is provided during all the second backlight period $L_2$, and the blue (B) backlight is provided during all the first backlight period $L_3$, i.e. the second sub backlight period is 100% in the first backlight period, in the second backlight period, and the third backlight period. Namely, no color gamut space shrinking is carried out at this time in order to maintain enough color saturation of the display.

In summary, the embodiment uses the backlight display sequence CRMGYB to display the R, G, and B image data so as to shrink the color gamut space of the LCD. Thus, the CBU is reduced. Meanwhile, the embodiment performs a color mixing of secondary color axis on an un-operating region of a primary color axis. Namely, the C, M, and Y backlights are inserted to display among the original R, G, and B backlights and the enabled periods of the C, M, and Y backlights are determined upon each color gamut space of frames. Therefore, the CBU is reduced. Besides, the diminution of whole gray level and colorfulness of frames result from decreasing the enabled periods of the backlights of the primary colors are compensated.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A color sequential control method adapted to a field sequential color display (FSCD), comprising a display panel and a backlight module, wherein the backlight module provides a backlight source to the display panel and the backlight source comprises a red backlight, a blue backlight and a green backlight, the color sequential control method comprising:

sequentially dividing a frame period of the display panel into a first sub-frame period, a second sub-frame period and a third sub-frame period;

providing a cyan backlight during a first sub backlight period of a first backlight period of the first sub-frame period and then providing the red backlight during a second sub backlight period of the first backlight period of the first sub-frame period so as to display a red image data by the cyan backlight and the red backlight;

sequentially providing a magenta backlight and then the green backlight during a second backlight period of the second sub-frame period so as to display a green image data by the cyan backlight and the green backlight;

sequentially providing a yellow backlight and then the blue backlight during a third backlight period of the third sub-frame period so as to display a blue image data by the yellow backlight and the blue backlight;

writing the red image data into the display panel during the first sub-frame period;

writing the green image data into the display panel during the second sub-frame period;

writing the blue image data into the display panel during the third sub-frame period;

calculating a minimum color gamut space according to a maximum chroma of the red image data, a maximum chroma of the green image data and a maximum chroma of the blue image data;

determining a ratio of the first sub backlight period of the first backlight period to the second sub backlight period of the first backlight period according to the minimum color gamut space;

determining if the minimum color gamut space is less than or equal to 50% of an original color gamut space of the backlight source; and when the minimum color gamut space is less than or equal to 50% of the original color gamut space, the second sub backlight period of the first backlight period is 100% in the first backlight period.

2. The color sequential control method of claim 1 further comprising providing the magenta backlight during a first sub backlight period of the second backlight period of the second sub-frame period and providing the green backlight during a second sub backlight period of the second backlight period of the second sub-frame period.

3. The color sequential control method of claim 2 further comprising:

determining if the minimum color gamut space is less than or equal to 50% of an original color gamut space of the backlight source; and when the minimum color gamut space is less than or equal to 50% of the original color gamut space, the second sub backlight period is 100% in the second backlight period.

4. The color sequential control method of claim 2 further comprising providing the yellow backlight during a first sub backlight period of the third backlight period of the third sub-frame period and providing the blue backlight during a second sub backlight period of the third backlight period of the third sub-frame period.

5. The color sequential control method of claim 4 further comprising:

determining if the minimum color gamut space is less than or equal to 50% of an original color gamut space of the backlight source; and when the minimum color gamut space is less than or equal to 50% of the original color gamut space, the second sub backlight period is 100% in the third backlight period.

6. The color sequential control method of claim 1, wherein the cyan backlight is composed by the green and the blue backlights.

7. The color sequential control method of claim 1, wherein the magenta backlight is composed by the red and the blue backlights.

8. The color sequential control method of claim 1, wherein the yellow backlight is composed by the red and the green backlights.

9. A field sequential color display (FSCD) comprising:

a display panel, wherein a frame period of the display panel is sequentially divided into a first sub-frame period, a second sub-frame period, and third sub-frame period;

a backlight module, providing a backlight source to the display panel, wherein the backlight source comprises a red backlight, a blue backlight and a green backlight, the backlight module sequentially providing a cyan backlight and then the red backlight during a first backlight period of the first sub-frame period so as to display a red image data by the cyan backlight and the red backlight, sequentially providing a magenta backlight and then the green backlight during a second backlight period of the second sub-frame period so as to display a green image data by the magenta backlight and the green backlight, and sequentially providing a yellow backlight and then the blue backlight during a third backlight period of the third sub-frame period so as to display a blue image data by the yellow backlight and the blue backlight, wherein the first backlight period, the second backlight period and the third backlight period respectively comprise a first sub backlight period and a second sub backlight period, and the backlight module provides the cyan backlight during the first sub backlight period of the first backlight period, provides the red backlight during the second sub backlight period of the first backlight period, provides the magenta backlight during the first sub backlight period of the second backlight period, provides the green backlight during the second sub backlight period of the second backlight period, provides the yellow backlight during the first sub backlight period of the third backlight period, and provides the blue backlight during the third sub backlight period; and a sequential color controller comprising a processing module, wherein the processing module writes the red image data into the display panel during the first sub-frame period, writes the green image data into the display panel during the second sub-frame period and writes the blue image data into the display panel during the third sub-frame period, the processing module according to a maximum chroma of the red image data, a maximum chroma of the green image data and a maximum chroma of the blue image data calculates a minimum color gamut space, and determines a ratio of the first sub backlight period to the second sub backlight period according to the minimum color gamut space, the processing module comprises:

a chroma analyzing unit analyzing the red image data, the green image data and the blue image data to obtain a first red image data corresponding to the maximum chroma of the red image data, a first green image data corresponding to the maximum chroma of the green image data, and a first blue image data corresponding to the maximum chroma of the blue image data;

a color gamut deciding unit coupled to the chroma analyzing unit, calculating the minimum color gamut space according to the first red image data, the first green image data and the first blue image data, generating a first pulse width modulation (PWM) control signal, a second PWM control signal and a third PWM control signal according to the minimum color gamut space so as to adjust the ratio of the first sub backlight period to the second sub backlight period, the color gamut deciding unit comprises:

a first transformation matrix unit calculating a first reference coordinate, a second reference coordinate and a third reference coordinate in a CIE1931 color space chromaticity diagram which respectively correspond to the first red image data, first green image data and first blue image data;

a color gamut analyzing unit determining the minimum color gamut space upon the first reference coordinate, the second reference coordinate, and the third reference coordinate and outputting the first reference coordinate, the second reference coordinate, and the third reference coordinate;

a second transformation matrix unit respectively transforming the first reference coordinate, the second reference coordinate, and the third reference coordinate into the first red image data, the first green image data, and the first blue image data;

a backlight compensation unit determining the ratio of the first sub backlight period to the second sub backlight period according to the minimum color gamut space so as to generate a first backlight control signal, a second backlight control signal, and a third backlight control signal; and a PWM generating unit generating the first PWM control signal, the second PWM control signal, and the third PWM control signal respectively according to the first backlight control signal, the second backlight control signal, and the third backlight control signal, so as to adjust the ratio of the first sub backlight period to the second sub backlight period; and a data generating unit sequentially outputting the red image data, the green image data and the blue image data.

10. The field sequential color display of claim 9, wherein the backlight compensation unit determines if the minimum color gamut space is less than or equal to 50% of an original color gamut space of the backlight, and when the minimum color gamut space is less than or equal to 50% of the original color gamut space, the second sub backlight period is 100% in the first backlight period.

11. The field sequential color display of claim 9, wherein the cyan backlight is composed by the green and the blue backlights.

12. The field sequential color display of claim 9, wherein the magenta backlight is composed by the red and the blue backlights.

13. The field sequential color display of claim 9, wherein the yellow backlight is composed by the red and the green backlights.

* * * * *